United States Patent [19]

Clapper

[11] 4,337,588

[45] Jul. 6, 1982

[54] DIGITAL SPRING ROLL DISPLAY DEVICE

[75] Inventor: Robert C. Clapper, Racine, Wis.

[73] Assignee: DCI Marketing, Milwaukee, Wis.

[21] Appl. No.: 279,702

[22] Filed: Jul. 2, 1981

[51] Int. Cl.[3] ..... G09F 3/18

[52] U.S. Cl. ..... 40/10 R; 40/5; 40/518; 40/446

[58] Field of Search ..... 40/5, 364, 471, 518, 40/576, 10

[56] References Cited

U.S. PATENT DOCUMENTS

| | | | |
|---|---|---|---|
| 1,473,035 | 11/1923 | Gottfried | 40/5 X |
| 1,553,906 | 9/1925 | Marette | 40/362 X |
| 1,890,117 | 12/1932 | Jeffreys | 40/116 |
| 1,999,133 | 4/1935 | Shapiro | 40/362 X |
| 2,588,803 | 3/1952 | Coffey | 40/518 |
| 2,939,584 | 2/1976 | Trame | 40/10 R |
| 2,951,301 | 9/1976 | Slavsky | 40/17 |
| 3,016,638 | 8/1963 | Singer | 40/5 |
| 3,100,356 | 8/1963 | Offensend | 40/17 |
| 3,159,937 | 12/1964 | Barnes | 40/5 X |
| 3,426,115 | 2/1969 | Taber | 264/160 |
| 3,660,918 | 5/1972 | Bourseau | 40/374 |
| 4,095,359 | 6/1978 | Trame | 40/446 |
| 4,143,477 | 5/1979 | Reynolds | 40/359 |
| 4,296,563 | 10/1981 | Clement | 40/518 |

*Primary Examiner*—Gene Mancene
*Assistant Examiner*—Wenceslao J. Contreras
*Attorney, Agent, or Firm*—Michael, Best & Friedrich

[57] ABSTRACT

The invention includes a display device having a support structure including an opening forming a display window and a spring roll visible through the window, the spring roll including display characters along its length and comprising material having the property of tending to form coils at its opposite ends. The display device also includes a spring roll carrier for supporting the spring roll closely adjacent the rearward surface of the window, this carrier including a planar member having a planar forward surface positioned closely adjacent but rearwardly of the window.

8 Claims, 6 Drawing Figures

DIGITAL SPRING ROLL DISPLAY DEVICE

FIELD OF THE INVENTION

The invention relates to point of purchase display devices and more particularly to display devices having a numerical or alphabetical display and wherein the characters displayed can be easily changed.

BACKGROUND OF THE INVENTION

Display devices having numerical or alphabetical displays have been constructed employing film strips having numerals or letters on the film and with the film strips being supported such that selected numerals or letters are visible through windows in a supporting structure. The visible letters or numerals are changed by rolling the film strip past the window in the supporting structure. Examples of such devices are illustrated in the U.S. Trame Pat. No. 3,939,584, issued Feb. 24, 1976 and the U.S. Trame Pat. No. 4,095,359, issued June 20, 1978.

Attention is also directed to the U.S. Taber Pat. No. 3,426,115, issued Feb. 4, 1969, the U.S. Shapiro Pat. No. 1,999,133, issued Apr. 23, 1935, the U.S. Marette Pat. No. 1,553,906, issued Sept. 15, 1925, the U.S. Jeffreys Pat. No. 1,890,117, issued Dec. 6, 1932 and the U.S. Barnes Pat. No. 3,159,937, issued Dec. 8, 1964. Also of interest are the U.S. Bourseau Pat. No. 3,660,918, issued May 9, 1972, the U.S. Offensend et al. Pat. No. 3,100,356, issued Aug. 13, 1963, the U.S. Slavsky Pat. No. 2,951,301, issued Sept. 6, 1960 and the U.S. Coffey Pat. No. 2,588,803, issued Mar. 11, 1952.

SUMMARY OF THE INVENTION

The present invention provides an improved display device wherein the numerals or letters displayed can be easily changed and wherein the display device has attractive qualities and appearance and is uncomplicated in structure and inexpensive to manufacture.

More particularly, the invention includes a display device including a support structure including a planar portion having a display window and a rearward surface defining a plane, and a spring roll positioned adjacent the rearward surface and being visible through the window. The spring roll includes display characters along its length and is comprised of material having the property of tending to form coils at its opposite ends. The display device also includes means for supporting the spring roll adjacent the plane defined by the rearward surface of the planar portion, this means for supporting including a planar member having a planar forward surface positioned closely adjacent but rearwardly of the rearward surface. One of the curled opposite ends of the spring roll is supported rearwardly of one of the edges of the planar member and the other of the curled opposite ends is supported rearwardly of the other of the edges of the planar member. Means are also provided for preventing movement of the ends of the spring roll past the edges of the planar forward surface, the means for preventing movement including apertures formed in the ends of the spring roll and including a first pin joined to one edge of the planar member and a second pin joined to the other edge of the planar member. One of the apertures is intended to slip over the first pin as the spring roll is moved in one direction until its end having the aperture is substantially uncoiled, and the other of the apertures is intended to slip over the second pin as the spring roll is moved in an opposite direction until its end having the aperture is substantially uncoiled.

Various other features and advantages of the invention are set forth in the following description, in the claims, and in the drawings.

BRIED DESCRIPTION OF THE DRAWINGS

Figure 1:
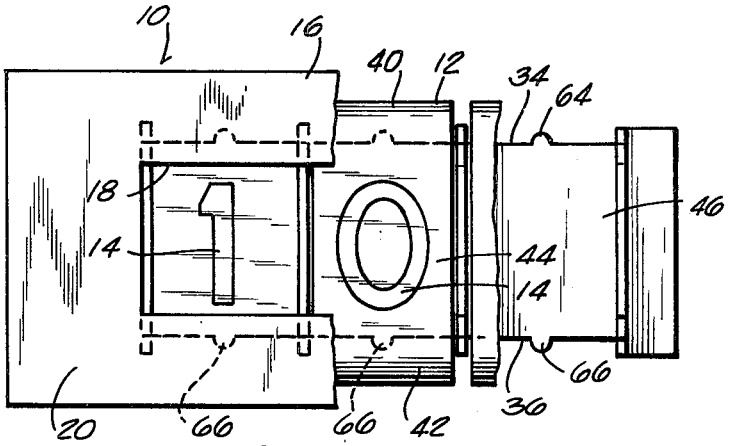
FIG. 1 is a partial elevation view of a display device embodying the invention and with portions broken away in the interest of clarity.

Before describing at least one embodiment of the invention detail, it is to be understood that the invention is not limited in its application to the details of construction nor to the arrangement of the specific components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

BRIEF DESCRIPTION OF A PREFERRED EMBODIMENT

Illustrated in FIG. 1 is a display device 10 embodying the invention and including a plurality of side-by-side spring rolls 12, the spring rolls 12 being comprised of precurled generally opaque plastic strips having display characters 14, such as the numbers shown in FIG. 1, along their length. The display device 10 also includes a support structure 16 having a central elongated window 18, and the spring rolls 12 are supported immediately rearwardly of the window 18 such that the numbers or display characters 14 are visible through the window 18. The spring rolls 12 are also supported such that they can be conveniently rolled or unrolled so that numbers 14 visible through the window 18 can be easily changed. In the arrangement illustrated in the drawings, the display device 10 could be used in a retail business to indicate, for example, the price of a product. This use of the display device is referred to merely for purposes of example, and it will be understood that there are a wide range of other potential uses of the display device of the invention.

Referring more particularly to the specific embodiment of the display device shown in the drawings, the support structure or body 16 is comprised of a planar member 22 including a face 24 and a rearward surface 26. While in the illustrated construction the support structure 16 includes a single elongated window 18, in other arrangements it could include a plurality of windows aligned longitudinally along the length of the support structure. The support structure also includes a pair of bushings or pins 28 extending rearwardly from the rearward surface 26 of the support structure 16 and intended to permit a spring roll carrier 30 to be fixed to the support structure 16.

The spring roll carrier 30 comprises an elongated thin flat plate member 32 adapted to be positioned closely adjacent the rearward surface 26 of the support member 16 but spaced rearwardly of the rearward surface. The spring roll carrier 30 has a height which is greater than the height of the window 18 and, accordingly, the upper edge 34 of the spring roll carrier 30 is above the upper edge of the window and the lower edge 36 of the spring roll carrier 30 is slightly below the lower edge of the window 18. While in other arrangements the spring roll carrier 30 could support more or fewer spring rolls 12, in the illustrated arrangement it is adapted to support three spring rolls in spaced relation along its length.

Figure 3:
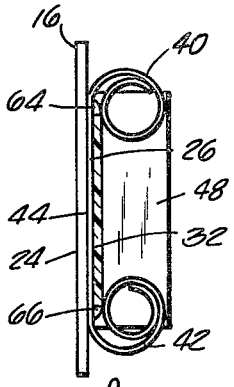
FIG. 3 is a cross section view taken along line 3—3 in FIG. 2.

The spring rolls 12 are comprised of a precurled thin plastic material, such as described in the Trame and Taber patents cited above, and having the numerical or alphabetical characters 14 on one surface and arranged linearly along the length of the spring roll. The spring roll material is characterized by the tendency to form coils at its opposite ends. The spring rolls are supported on the spring roll carrier and with each of the spring rolls having an upper coil 40 (FIG. 3) positioned immediately rearwardly of the upper edge 34 of the spring roll carrier and with a lower coil 42 positioned immediately rearwardly of the lower edge 36 of the carrier. The spring roll supported in this manner also includes an intermediate portion 44 positioned between the planar forward face 46 of the spring roll carrier 16 and the plane defined by the rearward surface 26 of the support structure, the intermediate portion 44 being planar and being supported against the face 46 of the spring roll carrier.

Figure 2:
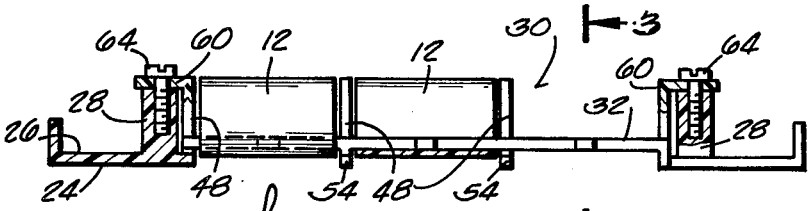
FIG. 2 is a plan view of the display device shown in FIG. 1.
Figure 4:
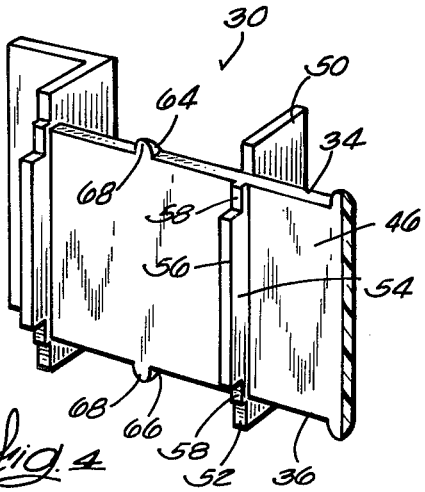
FIG. 4 is a partial perspective view of the spring roll supporting member illustrated in FIG. 1.

The spring roll carrier 16 also includes means for maintaining the spring rolls 12 in spaced apart relation along the length of the spring roll carrier, this means including a plurality of rearwardly extending planar dividers 48 spaced along the rearward surface of the planar member 32 of the spring roll carrier, the planar dividers 48 being integrally joined to the rear surface of the planar member. In the illustrated arrangement, the planar dividers 48 define planes perpendicular to the plane of the planar member 32 of the spring roll carrier and the planar dividers 48 include upper ends 50 (FIG. 4) extending upwardly beyond the upper edge 34 of the planar member 32 and lower ends 52 extending downwardly beyond the lower edges 36 of the planar member. The means for maintaining the spring rolls 12 in spaced relation also includes ribs 54 projecting from the forward face 46 of the spring roll carrier and extending from the upper edge 34 of the planar member to the lower edge 36. As shown in FIG. 4, the ends of the ribs are stepped such that the ribs include a central or intermediate portion 56 adapted to extend through the opening in the support member 16 defined by the window 18. The upper end of this intermediate portion 56 is adapted to be positioned closely adjacent the upper edge of the window and the lower end of the intermediate portion 56 is positioned closely adjacent the lower edge of the window. As shown in FIG. 2, these central or intermediate portions 56 of the rib divide or separate the face 46 of the planar member into discrete surface areas and prevent lateral movement of the spring rolls 12. The ribs 54 also include upper and lower end portions having forward faces 58 which are adapted to engage the rearward surface 26 of the support structure 16, these end portions of the ribs being adapted to maintain the forward face 46 of the plate member 32 in rearwardly spaced relation from the rearward surface 26 of the support structure.

The spring roll carrier 30 also includes a pair of wings 60 which extend outwardly from the ends of the carrier and which are parallel to the plane defined by the planar member 32. More particularly, the wings are integral with and extend outwardly from the rearward ends of the rearwardly extending dividers 48 forming the ends of the spring roll carrier. The wings 60 each include an aperture and are adapted to be positioned against the rearward ends of the pins 28. Means are also provided for securing the spring roll carrier 30 to the support structure 16. While various securing means could be provided, in the illustrated arrangement, screws 64 extend through the apertures in the wings 60, and the screws 64 are threaded into the ends of the pins 28 to thereby secure the wings of the carrier to the pins of the support structure.

Figure 5:
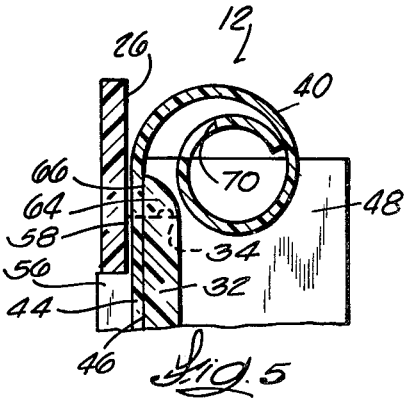
FIG. 5 is an enlarged partial cross section view taken along line 5—5 in FIG. 2.
Figure 6:
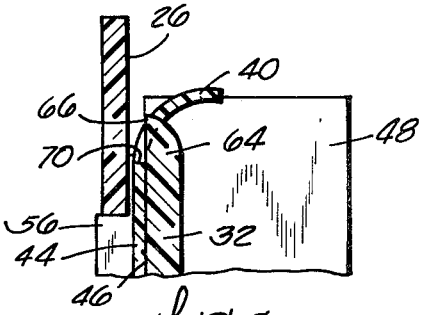
FIG. 6 is a view similar to FIG. 5 and showing an end of the spring roll engaging a projection of the spring roll supporting member to prevent further movement of the spring roll.

Means are also provided for preventing the opposite ends of the spring rolls 12 from being completely unrolled and pulled past the respective upper and lower edges 34 and 36 of the carrier. During use of the display device, numbers or characters 14 being displayed can be changed by moving that portion of the spring roll 12 in the window up or down thereby causing one end of the spring roll to uncoil while the other end of the spring roll coils. The means for preventing complete unrolling of the coils 40 and 42 of the spring rolls includes pins 64 extending upwardly from the upper edge of the planar member 32 and pins 66 extending downwardly from the lower edge of the planar member. In the illustrated construction the pins include a planar forward surface 68 which is coplanar with the surface or face 46 of the plate member 32. The rearward surface of the pins is rounded. The spring rolls are each provided with holes 70 formed in their opposite ends. As shown in FIGS. 5 and 6, as the spring rolls 12 are uncoiled, and as an end of a spring roll passes over the upper edge 34 of the plate member 32, that end of the spring roll tends to curl around the upper edge 34 and the pin 64 will extend into the aperture 70 as the aperture begins to pass over the upper edge 34 of the plate member. As the pin 64 moves into the aperture 70, it will prevent any further movement of the spring roll past the upper edge. If the spring roll is moved in the opposite direction, that end of the spring roll illustrated will slide up and off of the pin and again form a coil 40.

By reference to the above description of one embodiment of the invention and by reference to the drawings, it will be appreciated that the invention provides a simple and uncomplicated display device to be used in retail sales and in a variety of other applications as a means for providing a readily changeable sign or other display and wherein the parts forming the display device are simple and inexpensive to manufacture yet provide an attractive display device and wherein the characters displayed are easily changed.

Various features of the invention are set forth in the following claims.

I claim:

1. A display device comprising a support structure including a planar portion having a display window and a rearward surface defining a plane, a spring roll positioned adjacent said rearward surface and being visible through said window, said spring roll including display characters along its length and comprising a thin strip of material having the property of tending to form coils at its opposite ends, means for supporting said spring roll adjacent said plane defined by said rearward surface of said planar portion, said means for supporting including a planar member having a planar forward surface positioned closely adjacent but rearwardly of said rearward surface, said planar member having spaced parallel edges, one of said curled opposite ends being supported rearwardly of one of said edges and the other of said curled opposite ends being supported rearwardly of the other of said edges, and means for preventing movement of the ends of said spring roll past said edges of said planar forward surface, said means for preventing movement including apertures formed in the ends of said spring roll and including a first pin joined to said one edge and projecting away from said one edge and a second pin joined to said other edge and projecting away from said other edge, one of said apertures in one end of said spring being adapted to slip over said first pin as said spring roll is translated in one direction until its end having the aperture is substantially uncoiled, and the other of said apertures in the opposite end of said spring roll being adapted to slip over said second pin as said spring roll is translated in a direction opposite to said one direction until said opposite end is substantially uncoiled.

2. A display device as set forth in claim 1 and further including means for maintaining said planar surface in rearwardly spaced relation with respect to said rearward surface, said means for maintining including a projection extending from said forward surface and engageable against said rearward surface, said projection having a thickness greater than the thickness of said material forming said spring roll.

3. A display device as set forth in claim 1 wherein said one edge includes a forward portion positioned closely adjacent but in spaced relation from said rearward surface of said support structure, said forward portion and said rearward surface defining a gap therebetween for housing a portion of said spring roll and permitting slideable translation of said spring roll through said gap.

4. A display device as set forth in claim 3 wherein said one edge includes a rearward portion and wherein one of said coils is positioned against said rearward portion of said one edge.

5. A display device as set forth in claim 1 wherein said means for supporting said spring roll further includes guide means for preventing movement of said spring roll in a direction transverse to said direction of translation of said spring roll.

6. A display device as set forth in claim 5 wherein said means for supporting said coils in spaced relation includes a rib extending from said forward surface.

7. A display device as set forth in claim 6 wherein said planar member includes a rearward surface and wherein said means for supporting said coils in spaced relation includes a divider plate extending rearwardly from said rearward surface of said plate member, said divider plate defining a plane transverse to said planar member and transverse to said edges.

8. A display device as set forth in claim 1 wherein one end of said spring roll forms a coil adjacent said one edge and is positioned adjacent and rearwardly of said one edge and wherein said opposite end of said spring roll is positioned adjacent and rearwardly of said other edge.

* * * * *